United States Patent [19]

Tiedemann

[11] Patent Number: 4,523,617

[45] Date of Patent: Jun. 18, 1985

[54] THREE-IN-ONE WORK STATION

[76] Inventor: George V. Tiedemann, RD #3, Box 706, Howell, N.J.

[21] Appl. No.: 585,364

[22] Filed: Mar. 2, 1984

[51] Int. Cl.[3] ..... B25H 1/00

[52] U.S. Cl. ..... 144/286 A; 108/59

[58] Field of Search ..... 144/285, 286 R, 286 A; 248/121, 122, 166, 434; 108/28, 59, 69, 90; 269/16, 71; 83/859

[56] References Cited

U.S. PATENT DOCUMENTS 2,240,395 4/1941 Evans ..... 144/286 R

*Primary Examiner*—W. D. Bray
*Assistant Examiner*—Jorh M. Griffin
*Attorney, Agent, or Firm*—Charles I. Brodsky

[57] ABSTRACT

A work bench utilizing a pair of triangular sections to support three work surfaces, to each of which an electrical power or manually operable tool is secured, and with the triangular sections being releasably rotatable to bring one of the desired tools into proper operating position within a defined work space.

11 Claims, 6 Drawing Figures

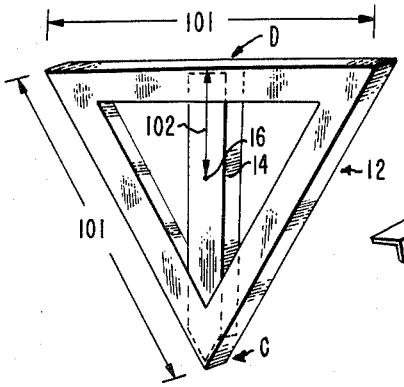
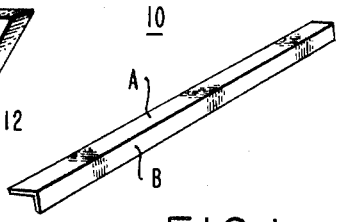
FIG. 1
FIG. 2
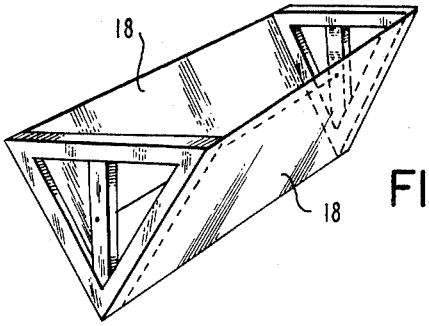
FIG. 3
FIG. 4
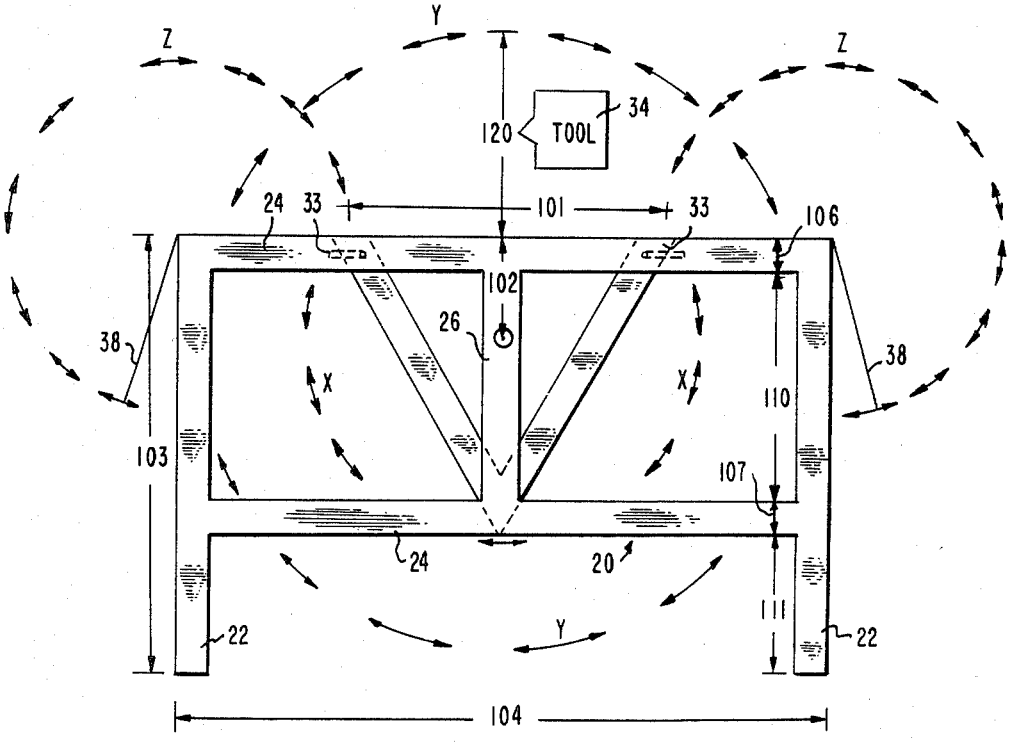

THREE-IN-ONE WORK STATION

FIELD OF THE INVENTION

This invention relates to work-benches, in general, and to a work-bench construction in which a plurality of electrical power and/or manually operable tools can be utilized in a defined work space, in particular.

BACKGROUND OF THE INVENTION

As is well known and understood, the "home craftsman" utilizes many different types of electrical power and/or manually operable tools of significant size and bulk—such as, a router, a table saw, a jigsaw, a miter box, etc. Most people usually only have a single work-bench, however, and when it is therefore desired to utilize one, or the other, of these types of equipment it becomes necessary to free the tool that has been used from the work-bench, store it aside, and then secure the new tool in place. Besides this being a time consuming problem each and every occasion that a change-over is to be made, another problem exists in the significant storage space required to put all these other tools when not being used. For many people, however, the work space is limited, so that the area to store these other power tools may just not be available. Usually, whatever storage space exists is taken up for the storage of hand tools, nails, screws, measuring devices, scribes, and so forth, and to then have to define a space for the storage of these large and cumbersome other tools oftentimes becomes not only impractable, but impossible.

SUMMARY OF THE INVENTION

As will become clear hereinafter, the present invention overcomes these difficulties through the provision of a work-bench construction in which any one of three work stations can be rotated into position, and to each of which one of three possible power or manual tools can be secured. In particular, and in accordance with a preferred embodiment of the invention, a pair of triangular sections are arranged to support each of these work stations on its corresponding sides, with the triangular sections then being secured to the work-bench construction by means of a rod passing through a brace for the triangular sections, and about which the sections can rotate. A pair of locking pins maintain the triangular sections fixed in position for one work tool placement, and which, upon release, permit the rotation of the triangular sections to bring the other tools into desired position, whence, the locking pins are then once again secured.

In accordance with a preferred embodiment of the invention, the triangular sections, and work-bench itself, are constructed of readily available, standard type angle irons, of right-angle construction, with the individual work stations being constructed of plywood, or similar pressed material, secured to the outer sides of the angle iron. The brace for the triangular sections extends from the apex of the triangle to the base, and receives a steel rod about which the triangular sections, along with its supported plywood work station, is arranged to rotate. By securing the desired tool to the work station beforehand, and by the selection of desired dimensions, as set forth below, the electrical power or manually operable tool can be rotated into its desired position for use, with sufficient clearance as regards the work-bench support legs, and with respect to the floor upon which the work-bench sits. With further provided protective shields to guard against debris falling from a work station into a tool being secured underneath, the Three-In-One work station of the invention will be seen to permit operation of three different tools in a work space normally needed for only one such tool, with the remaining two equipments being simply, and safely, stored out of the work area.

BRIEF DESCRIPTION OF THE DRAWINGS

These and other features of the present invention will be more clearly understood from a consideration of the following description, taken in connection with the accompanying drawing, in which:

FIG. 1 illustrates a readily available angle iron utilized in the present invention in fabricating the table frame and triangular work type constructions;

FIG. 2 illustrates one of the two triangular sections constructed in accordance with the invention;

FIG. 3 shows a pair of the triangular sections of FIG. 2 as they might be used in securing to three plywood sheets in supporting up to three electrical power or manually operable tools as might be used by a "home craftsman", with the top sheet removed for easy viewing; and FIGS. 4–6 show front, side and top views of a work-bench utilizing the arrangement of FIG. 3 in carrying out a preferred teaching of the invention.

DETAILED DESCRIPTION OF THE DRAWINGS

Figure 5:
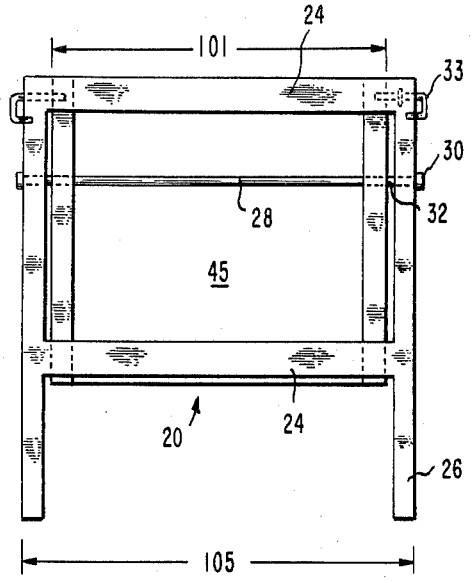

Referring to FIGS. 1–3, reference numeral 10 identifies a standard, readily available angle iron having an upper surface A of some 2¼ inch dimension, and a side surface B of some 1½ inch dimension, and which can be cut into any desired lengths. Preferred lengths of 24 inches are cut, according to the invention, with the three lengths either being bolted together, or welded together (the preferred way), to form an equilateral triangular 12, of 24 inch length sides. A brace 14 is then cut to shape, and secured between the apex C of the triangular sections 12 and its base (at D) with a drilled-through aperture 16 provided in each brace 14 some 7 inches down from the base The top surfaces A of the angle iron 10 are then bolted to three 24×24 inch square sheets of plywood, or similar pressed material, of a ¾ inch, or so thickness, as at 18 in FIG. 3. Although not shown, such plywood sheets can be provided with pluralities of recessed nuts, to receive bolts which pass through various flanges, or other such parts, of the tool to be secured to the plywood sheet.

(As will be appreciated by those skilled in the art, the 24 inch, 7 inch and angle iron widths and lengths are not to be limiting of the present invention, but are so selected having in mind the height, width and depth of a work-bench to be constructed utilizing the angle iron of FIG. 1, the height dimensions of the kinds of tools which can be utilized with the invention, and that height above the floor at which the craftsman can comfortably move about, and operate, any of the tools in question. In particular, the 24 inch and 7 inch dimensions, shown as 101 and 102, respectively, in FIGS. 4–6, were selected in accordance with a predetermined work-bench height 103 of some 30 inches, a work-bench width 104 of some 46 inches, and a work-bench depth 105 of 28 inches. It goes without saying, that modification of these work-bench dimensions might very well entail similar modifications in the dimensions 101, 102 in order for the operation of the triangular sections to continue without change.)

Figure 6:
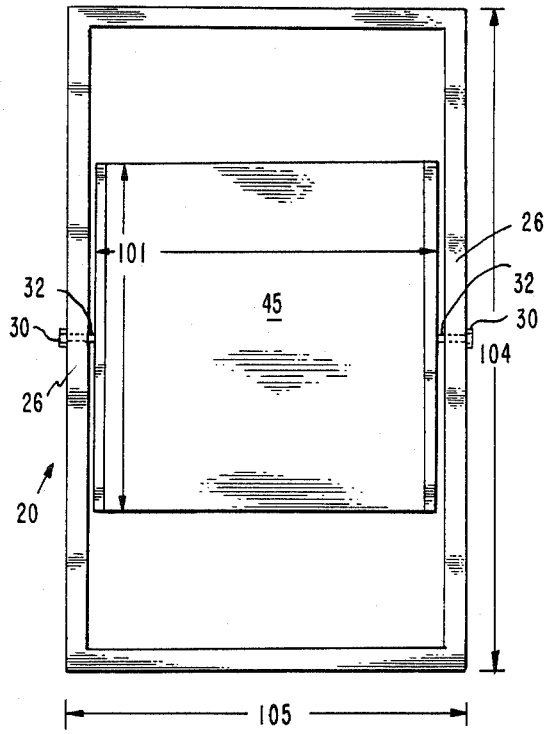

The work-bench frame 20 shown in FIGS. 4, 5 and 6 will be understood as being constructed of the angle iron 10 with its $2\frac{1}{4}$ inch dimension shown at 106, 107, with vertical sections 22, horizontal sections 24 and side supports 26. As illustrated more clearly in FIGS. 5 and 6, the side supports 26 are apertured at both front and back, co-linearly with the triangular sections 12 when placed in position (FIG. 4), and capable of receiving a steel bar 28 inserted to extend through the side support, the triangular sections, and out the other end. As shown in FIGS. 5 and 6, the rod 28 is to be secured tightly against the side supports 26 of the frame 20, as by means of a pair of nuts, or similar such fasteners 30. A pair of bushings 32 are also placed about the rod 28 in maintaining a $\frac{1}{2}$ inch, or so, clearance between the rotatable triangular section 12 and the interior side walls of the frame 20.

Also shown in FIGS. 5 and 6 are a pair of locking pins 33, of appropriate construction—such as being of "J" shape—under spring tension, and outwardly releasable and rotatable so as to free the triangular sections 12 from restraint. When so actuated, the lock pins 33 permit easy rotation of the triangular sections 12, the plywood sheets, and the tools secured in place thereat, all about the rod 28 traversing the side supports 26 and the brace aperture 16 as a fulcrum, until the desired tool is rotated into position, extending upwardly of the workbench, as shown by the representative tool location 34 (FIG. 4). With the assumed 30 inch height dimension 103, and with the sectional dimensions 110, 111 of FIG. 4 structured to be $15\frac{3}{4}$ inches and $9\frac{3}{4}$ inches respectively, applicant has found that a tool can be employed at location 34 up to a maximum center height of some 14 inches, and yet provide clearance as to the floor and side walls of the frame of approximately $1\frac{1}{4}$ inches when rotated about (the height being shown at 120).

As illustrated by the directional arrows X in FIG. 4, the triangular sections 12 and their plywood supports 18 can be rotated either clockwise or counter-clockwise. As shown by the directional arrows Y, the tools secured in place can then similarly be rotated on the plywood sheets 18 also clockwise, or counter-clockwise.

Additionally shown in FIG. 4 are a pair of hinged shields, of an 11×27 inch selected rectangular dimension, for an available rotation shown by the directional arrows Z inwardly of the work-bench frame. Such shield, which may be constructed of a wood material, can be rotated to sit atop the frame support 26 as an aid in preventing any dust, wood or other chip debris generated during the use of the tool from falling downwardly through the table top frame work, and into the mechanism of any underlying tool, as a protective against damage. When the tool is not being used, the shield 38 can be maintained in either its up-or-down positions.

While there has been described what is considered to be a preferred embodiment of the present invention, it will be readily appreciated by those skilled in the art that modifications can be made without departing from the scope of the teachings herein of rotatably positioning one of three tools to a desired work top station simply by releasing the triangular sections to be angulated into position along with the plywood supports and tools secured thereto. It will be readily apparent, furthermore, that materials other than plywood can be used in securing between the triangular sections and the tools to be carried, depending upon manufacturer fabrication. And, although the invention has proved particularly attractive with a construction in which angle iron serves as the major component, other constructional materials may similarly be used, as long as they do not interfere with the rotational aspects of the triangular sections, supporting the materials which in turn support the desired tool in bringing into the determined work station position desired. Thus, for example, modifications can be made to the construction to provide added clip-type arrangements to prevent any included plastic cover available with the tool from falling away during rotation, without departing from the scope of the teachings herein. And, although the preferred embodiment described above illustrates a locking arrangement in which two (or four) pins 33 are used to control the rotation of the worktable 45 formed by the plywood sheets 18, it will be appreciated that similar control could be had if only a single lock arrangement were employed. For at least such reasons, therefore, resort should be had to the claims appended hereto for a correct understanding of the scope of the invention.

I claim:

1. Apparatus comprising:

a workbench frame having;

(a) four vertically extending support members;

(b) four horizontally extending members joining corresponding upper most portions of said support members together in forming a top frame structure (c) two horizontally extending, oppositely positioned, members joining corresponding intermediate portions of adjacent support members together;

(d) two vertically extending, oppositely positioned, members joining said two horizontally extending members to the two of said four horizontally extending members positioned thereabove in forming a pair of side frame structures; and (e) with each of said two vertically extending members being apertured at corresponding locations thereon;

a worktable in the form of a triangular solid presenting;

(a) three major surfaces, to each of which a desired electrically powered or manually operable worktool is securable; and (b) two oppositely positioned side surfaces joining said three major surfaces together; and (c) with each of said two side surfaces being apertured at corresponding locations thereon;

a transverse rod serially extending through one of said apertures of said two vertically extending members of said workbench frame, through said apertures of said two side surfaces of said worktable, and through said other aperture of said two vertically extending members in forming a fulcrum about which said worktable is rotatable within said workbench frame;

and means detachably coupling at least one selected location along said worktable surfaces to at least one selected location along said workbench frame for controllably locking said worktable in place once a desired worktool is rotated into desired position.

2. The apparatus of claim 1 in which individual members of said workbench frame are fabricated of an angle iron construction.

3. The apparatus of claim 1 in which said worktable includes a pair of oppositely aligned triangular sections configured to securingly accept three planar tabletop constructions extending therebetween in providing work surfaces for said electrically powered or manually operable tools in use.

4. The apparatus of claim 3 in which said triangular sections are each of equal length sides, in which a brace member is further included as extending from a first apex of said triangle to a base side opposite thereto, and in which said brace member is apertured to receive said transverse rod in permitting rotation of said triangular solid worktable.

5. The apparatus of claim 4 in which said triangular sections are fabricated of an angle iron construction configured to securingly accept said planar table top constructions.

6. The apparatus of claim 6 in which said planar tabletop construction is fabricated of a plywood material.

7. The apparatus of claim 1 in which there is also included means to secure said transverse rod to the sides of said two vertically extending members remote from said worktable.

8. The apparatus of claim 7 in which there is additionally included means, situate between said vertically extending members and each of said two worktable side surfaces, and further apertured to receive said transverse rod for maintaining a relatively fixed clearance between said vertically extending members and each of said two worktable side surfaces.

9. The apparatus of claim 1 in which said detachable coupling means includes a pair of locking pins extendable through said vertically extending support members to link with said worktable surfaces for adaptive securing of said worktable in place.

10. The apparatus of claim 1 in which there is additionally included at least one protective shield member rotatable from said top frame structure inwardly thereof and towards said worktable extending therebetween.

11. Apparatus comprising:

(a) four vertically extending legs A, B, C, D;

(b) four horizontally extending members E, F, G, H joining the tops of said four legs together;

(c) one horizontally extending member I joining legs A, B together at an intermediate point thereof in forming a "front" side to said apparatus;

(d) one horizontally extending member J joining legs C, D together at an intermediate point thereof in forming a "back" side to said apparatus;

(e) one vertically extending member K joining horizontal member E to horizontal member I;

(f) one vertically extending member L joining horizontal member G to horizontal member J;

(g) with horizontal members E and G being parallel to one another, with horizontal members F and H being parallel to one another, and with horizontal member E being perpendicular to horizontal member F;

(h) a first aperture M in vertical member K;

(i) a second aperture N in vertical member L, being co-linear with aperture M;

(j) a triangular solid having opposing side surfaces P and Q, respectively, each in the form of an equilateral triangle having a vertical member correspondingly extending from an apex of the triangle to the triangular side opposite thereto;

(k) a third aperture R in triangular side surface P;

(l) a fourth aperture S in triangular side surface Q being co-linear with aperture R;

(m) with each of said apertures M, N, R, S being further co-linear;

(n) a transverse rod T extending through apertures M, N, R and S;

(o) first means for securing opposite ends of rod T to vertical members K and L;

(p) and second means for releasably locking at least one of said triangular side surfaces P and Q to horizontal members E and G; and (q) such that in one position of said second means, said triangular solid is free to be rotated about said transverse rod T, and such that in another position of said second means, said triangular solid is prevented from being rotated about transverse rod T.

* * * * *